US010041457B2

(12) United States Patent
Male

(10) Patent No.: US 10,041,457 B2
(45) Date of Patent: Aug. 7, 2018

(54) PUMP UNIT

(75) Inventor: Andrew Male, Walton on Thames (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 509 days.

(21) Appl. No.: 13/382,417

(22) PCT Filed: Jun. 30, 2010

(86) PCT No.: PCT/EP2010/059300
§ 371 (c)(1),
(2), (4) Date: Jan. 5, 2012

(87) PCT Pub. No.: WO2011/003789
PCT Pub. Date: Jan. 13, 2011

(65) Prior Publication Data

US 2012/0103179 A1 May 3, 2012

(30) Foreign Application Priority Data

Jul. 8, 2009 (EP) ..... 09164887

(51) Int. Cl.
*F02M 59/36* (2006.01)
*F04B 7/00* (2006.01)
(Continued)

(52) U.S. Cl.
CPC ..... *F02M 59/361* (2013.01); *F02M 59/365* (2013.01); *F02M 59/442* (2013.01);
(Continued)

(58) Field of Classification Search
CPC .... F04B 1/0404; F04B 1/0438; F04B 1/0452; F04B 1/0533; F04B 1/184; F04B 7/0015;
(Continued)

(56) References Cited

U.S. PATENT DOCUMENTS 554,604 A * 2/1896 Morgan ..... F04B 53/109 137/512.3
3,260,217 A * 7/1966 Thresher ..... 417/567
(Continued)

FOREIGN PATENT DOCUMENTS

CN 1041027 A 4/1990
CN 101238282 A 8/2008
(Continued)

OTHER PUBLICATIONS

English Translation of China Office Action dated May 20, 2013.
International Search Report dated Oct. 14, 2010.

*Primary Examiner* — Bryan Lettman
*Assistant Examiner* — Charles W Nichols
(74) *Attorney, Agent, or Firm* — Joshua M. Haines

(57) ABSTRACT

A pump unit has an inlet valve, an outlet valve, a supply line for supplying fuel, a pumping chamber, and a plunger for pressurizing fuel in the pumping chamber. The inlet valve includes an inlet valve member movable between a first position and a second position. The inlet valve member has an aperture formed therein. The aperture provides a first fluid pathway between the pumping chamber and the supply line when the inlet valve member is in its first position, and the aperture provides a second fluid pathway between the pumping chamber and the outlet valve when the inlet valve member is in its second position.

6 Claims, 9 Drawing Sheets

(51) Int. Cl.

| | |
|---|---|
| ***F02M 59/44*** | (2006.01) |
| ***F02M 61/16*** | (2006.01) |
| ***F04B 1/04*** | (2006.01) |
| ***F04B 53/16*** | (2006.01) |
| ***F02M 59/46*** | (2006.01) |

(52) U.S. Cl.
CPC ..... *F02M 59/464* (2013.01); *F02M 61/166* (2013.01); *F04B 1/0404* (2013.01); *F04B 1/0452* (2013.01); *F04B 7/0015* (2013.01); *F04B 53/16* (2013.01)

(58) Field of Classification Search
CPC .... F04B 7/0011; F04B 7/0003; F04B 7/0057; F04B 7/0069; F04B 7/0073; F04B 7/0084; F04B 7/0088; F04B 7/0092; F04B 7/0096; F04B 7/0216; F04B 7/0266; F04B 7/0291; F04B 19/02; F04B 19/022; F04B 39/08; F04B 39/1046; F04B 53/108; F04B 53/109; F04B 17/05; F04B 53/16; F02M 21/0245; F02M 37/06; F02M 37/0052; F02M 59/102; F02M 59/361; F02M 59/365; F02M 59/44; F02M 59/442; F02M 59/464; F02M 61/166; Y10T 137/7922; Y10T 137/7925; Y10T 137/7927
USPC ..... 417/415, 451, 495, 559, 562, 566, 567, 417/569, 571; 123/495, 508; 137/512, 137/512.3, 614.21, 535, 538, 539
See application file for complete search history.

(56) References Cited

U.S. PATENT DOCUMENTS

| | | | | |
|---|---|---|---|---|
| 3,742,822 | A * | 7/1973 | Talbert | 92/86 |
| 4,146,355 | A * | 3/1979 | Broker | F04B 7/04 417/454 |
| 4,722,675 | A * | 2/1988 | Albarda | F04B 9/047 417/509 |
| 4,741,680 | A * | 5/1988 | Broker | F04B 53/1002 417/567 |
| 4,840,548 | A * | 6/1989 | Hammelmann | F04B 53/164 417/296 |
| 5,033,506 | A | 7/1991 | Bolinger et al. | |
| 5,037,276 | A * | 8/1991 | Tremoulet, Jr. | 417/567 |
| 5,639,229 | A * | 6/1997 | Cooke | 417/440 |
| 5,775,886 | A * | 7/1998 | Terwilliger | 417/553 |
| 6,086,338 | A * | 7/2000 | Higgins | F04B 5/00 417/392 |
| 6,217,299 | B1 | 4/2001 | Jay | |
| 6,845,752 | B2 | 1/2005 | Jay et al. | |
| 7,121,812 | B2 * | 10/2006 | Forrest | 417/269 |
| 7,546,832 | B2 | 6/2009 | Okamoto et al. | |
| 7,757,667 | B2 | 7/2010 | Okamoto et al. | |
| 2006/0016906 | A1 * | 1/2006 | Matsumoto | 239/102.2 |
| 2006/0093490 | A1 | 5/2006 | Kleinbeck et al. | |

FOREIGN PATENT DOCUMENTS

| | | |
|---|---|---|
| DE | 617771 C | 8/1935 |
| DE | 4320620 | 1/1995 |
| DE | 102008002169 | 12/2009 |
| EP | 1281861 | 2/2003 |
| EP | 1323919 | 7/2003 |
| EP | 1355059 | 10/2003 |
| EP | 1403509 | 3/2004 |
| EP | 1411238 | 4/2004 |
| GB | 2194001 | 2/1988 |
| GB | 2 421 543 A | 6/2006 |
| JP | 4-21757 | 2/1992 |
| JP | 4-100063 | 8/1992 |
| JP | 09-222056 | 8/1997 |
| JP | 11-132129 | 5/1999 |
| JP | 2004-138063 A | 5/2004 |
| WO | 2007/017627 A2 | 2/2007 |
| WO | 2010015448 | 2/2010 |

* cited by examiner

PUMP UNIT

TECHNICAL FIELD

The present application relates to a pump unit. More particularly, the present application relates to a pump unit for a fuel injection system for an internal combustion engine.

BACKGROUND OF THE INVENTION

There is an increasing need for improved efficiency of internal combustion engines. In order to meet these needs and to comply with new emissions legislation, the operating pressure of diesel engines continues to increase and operating pressures of 3000 bar (300 MPa) are envisaged. However, these increased operating pressures present a variety of technical problems.

It is known to provide a fuel injection pump unit comprising a plunger operating within a barrel to raise fuel pressure before discharging the pressurised fuel to a high pressure manifold. However, known pump units are generally unsuitable for operating at the increased pressures now required. A prior art pump unit of this type is illustrated in FIG. 1 and described in detail below.

Known pump units typically rely on a combination of static and dynamic seals to seal the pumping chamber. However, due to the alternating pressure cycles encountered within the pump unit, even small inaccuracies in the manufacturing process may cause a seal to fail. For example, a high pressure static seal is typically provided to separate the low pressure supply gallery and the pressure chamber. The seal encounters cyclical pressure changes from very low to very high and, as a result of differential radial expansion, relative motion may be induced between the surfaces on each side of the seal interface. Even if the resulting motion is very small, fretting wear and failure may result.

Furthermore, the internal geometry of known pump units may include intersecting bores and these may result in high stresses being induced during operation. To ensure safe and reliable operation, the pump head may have to be formed from higher specification materials or specialised manufacturing processes used to reduce the operational stresses.

A further problem exacerbated by operating at high pressures is increased fuel leakage which may result in higher fuel consumption. The high pressures generated within the pumping chamber may result in radial expansion of the barrel. As there is no corresponding expansion of the plunger, fuel leakage past the plunger may result.

It is known from EP 12821861 to provide a fuel injection pump unit comprising a piston movable axially in a pump working space, a non-return piston and a shut-off piston. The non-return piston and the shut-off piston are both movable to engage each other during a compression stroke. Thus, the fuel injection pump requires that the pistons form a seal with each other and also with the housing to form a seal during the compression stroke. The requirement that the relative movement of both pistons is controlled is not ideal. Moreover, leakage from the pumping working space may be increased since two separate seals are required.

The present invention(s) at least in preferred embodiments attempts to overcome or ameliorate at least some of the problems associated with known pump units.

SUMMARY OF THE INVENTION

Viewed from a first aspect, the present application relates to a pump unit for a fuel injection system, the pump unit comprising:

an inlet valve member, an outlet valve, a supply line for supplying fuel, a pumping chamber, and a plunger for pressurising fuel in the pumping chamber;

the inlet valve member being movable between a first position and a second position;

wherein the inlet valve member has an aperture formed therein, the aperture providing a first fluid pathway between the pumping chamber and the supply line when the inlet valve member is in said first position, and the aperture providing a second fluid pathway between the pumping chamber and the outlet valve when the inlet valve member is in said second position. Thus, the supply of fuel from the supply line to the pumping chamber and from the pumping chamber to the outlet valve can be controlled by the inlet valve member during the different phases of the operating cycle of the pump unit.

At least in preferred embodiments, this arrangement can obviate the need to provide separate static and dynamic seals. Preferably, the inlet valve member can provide a fluid pathway directly from the supply line to the pumping chamber thereby removing the need to provide a static seal between the pumping chamber and the supply line.

When the inlet valve member is in said first position, the first fluid pathway between the supply line and the pumping chamber is open so that fuel can enter the pumping chamber. Once fuel has entered the pumping chamber, the inlet valve member can be displaced to said second position to place an interior of the pumping chamber in fluid communication with the outlet valve. When the inlet valve member is in said second position, the first fluid pathway between the supply line and the pumping chamber is preferably at least substantially closed. Most preferably, the inlet valve member forms a seal at least substantially to close the first fluid pathway when the inlet valve member is in said second position. Thus, the pumping chamber preferably communicates exclusively with the outlet valve when the inlet valve member is in said second position.

The outlet valve can comprise a movable outlet valve member and an outlet valve body. The inlet valve member can form a seal with the outlet valve body when the inlet valve member is in said second position. The outlet valve member can be movable within the outlet valve body. The outlet valve body can be fixed relative to a pump head, for example by forming the outlet valve body integrally with the pump head or fixedly mounting the outlet valve body in the pump head. In operation, the outlet valve body can remain stationary in relation to the pump head and the outlet valve member can be movable relative to the pump head.

The outlet valve member can be an impervious member locatable in a valve seat formed in the outlet valve body to seal the outlet. For example, the outlet valve member can be a spherical valve ball.

The inlet valve member preferably forms a seal with the body of the outlet valve when it is in said second position. This arrangement is advantageous since it means that a seal can be formed distal from the head of the plunger. Thus, unlike prior art arrangements in which high pressure fuel is sealed at the head of the plunger, it is not necessary for static sealing against the head.

In use, as it moves from said first position to said second position, the inlet valve member can move in the same direction as the plunger when it advances to pressurise fuel in the pumping chamber. Moreover, as it moves from said second position to said first position, the inlet valve member can move in the same direction as the plunger when it retracts to draw fuel into the pumping chamber.

In use, the fluid in the pumping chamber is pressurised by the plunger. The plunger is preferably driven by a cam or other suitable drive means. The movement of the inlet valve member between said first and second positions is preferably controlled by the pressure of the fluid within the pumping chamber. An inlet valve return spring can be provided to return the inlet valve member to either said first position or said second position. The outlet valve preferably controls the flow of pressurised fluid from the pumping chamber to a high pressure outlet line or manifold.

The inlet valve member forms part of an inlet valve. The inlet valve is preferably a concentric valve. The outlet valve is preferably a concentric valve. The inlet valve and the outlet valve can both be concentric valves to reduce the stress in the pump unit.

A second aperture can be formed in the outlet valve body for providing fluid communication with the aperture formed in the inlet valve member. When the inlet valve member is in said second position, the inlet valve member can form a seal around the second aperture formed in the outlet valve body. Thus, when the inlet valve member is in said second position, the apertures in the outlet valve body and the inlet valve member can be arranged in sole fluid communication with each other, thereby defining the second fluid pathway. The aperture in the inlet valve member and the aperture in the outlet valve body can be formed substantially co-axially with each other; and optionally also co-axially with the plunger.

The outlet valve member is preferably biased to a closed position by an outlet valve return spring. Preferably, the inlet valve member and the outlet valve member are movable in the same direction. The inlet valve member and the outlet valve member are preferably arranged to undergo displacement along substantially parallel axes or, more preferably, along a common axis.

The plunger preferably travels in a barrel. A seal is preferably created between the plunger and the barrel for reducing or preventing fuel leakage between the barrel and the plunger when the fuel is pressurised. Preferably, a drain outlet is provided for collecting any leaked fuel.

The pump unit preferably comprises a pump head made of a first material. An insert is preferably provided in the pump head to define a sidewall of the pumping chamber. The insert is preferably in the form of a sleeve to define a barrel in which the plunger travels. The insert can be made of a second material having a higher Young's Modulus (E) than the first material. The second material can have a Young's Modulus of greater than or equal to 400 MPa, or greater than or equal to 500 MPa. This arrangement can reduce leakage around the plunger when the pumping chamber is pressurised.

The pump unit can further comprise a pushrod having a sleeve or bore for forming the pumping chamber. In this arrangement a body portion of the inlet valve member can extend into the sleeve or bore to function as the plunger for pressurising fuel In preferred embodiments, a chamber or recess can be formed in the inlet valve member to define said pumping chamber. In use, an end of said plunger can operably extend into said pumping chamber. In use, a seal is preferably formed between said plunger and the inlet valve member to seal the pumping chamber.

A sealing ring can be movably mounted on the plunger. The sealing ring can provide a dynamic seal to help reduce or minimise leakage past the plunger. The sealing ring is preferably movable axially within a recess formed in the pump head around the plunger. The recess is preferably annular. The sealing ring can take the form of a piston ring.

Viewed from a further aspect, the present application relates to a pump unit for a fuel injection system, the pump unit comprising:

an inlet sealing ring, a pumping chamber and a plunger for pressurising fuel in the pumping chamber;

the inlet sealing ring being movably mounted on the plunger;

wherein the sealing ring is movable between a first position in which a fluid pathway is provided between the pumping chamber and a supply line for supplying fuel, and a second position in which the fluid pathway between the pumping chamber and the supply line is sealed. At least in preferred embodiments, the sealing ring can function both as a seal for the plunger and also as an inlet valve for controlling the supply of fluid to the pumping chamber.

In use, the inlet sealing ring is preferably movable in response to changes in fluid pressures within the pumping chamber. The inlet sealing ring is preferably movable axially within a recess extending around the plunger. The recess is preferably annular. The recess can, for example, be formed in a pump head defining the pumping chamber.

Preferably, when in said second position, the inlet sealing ring abuts a face or an end wall of the annular recess to form a seal thereby closing the fluid pathway between the pumping chamber and the supply line.

Viewed from a yet further aspect, the present application relates to a pump unit for a fuel injection system, the pump unit comprising: an inlet valve comprising an inlet valve member, and an outlet valve comprising an outlet valve member; wherein the inlet valve member and the outlet valve member are movable along a common axis. At least in preferred embodiments, the co-axial arrangement of the inlet and outlet valves is inherently stronger than prior art arrangements.

Viewed from a still further aspect, the present application relates to a pump unit for a fuel injection system, the pump unit comprising: an inlet valve, an outlet valve and a plunger movably mounted in a pumping chamber; the outlet valve comprising an outlet valve member; wherein the plunger and the outlet valve member are movable along a common axis or along substantially parallel axes.

The inlet valve preferably comprises an inlet valve member. The inlet valve member is preferably movable along an axis which is substantially parallel to or substantially coincident with the axis along which the plunger and the outlet valve member are movable.

Viewed from a yet still further aspect, the present application relates to a pump unit for a fuel injection system, the pump unit comprising: an inlet valve member, an outlet valve, a supply line for supplying fuel, and a pushrod; the inlet valve member being movable between a first position and a second position; wherein a chamber is formed in the pushrod to define a pumping chamber, the pumping chamber being in fluid communication with the supply line when the inlet valve member is in said first position, and the pumping chamber being in fluid communication with the outlet valve when the inlet valve member is in said second position. In use, a portion of the inlet valve member preferably extends into the pumping chamber to function as a plunger.

Viewed from a further aspect, the present application relates to a pump unit for a fuel injection system, the pump unit comprising: an inlet valve for controlling the supply of fuel from a supply line to a pumping chamber, and an outlet valve for controlling the supply of pressurised fuel from the pumping chamber to a high pressure outlet line; wherein the inlet valve is a concentric valve and/or the outlet valve is a concentric valve.

As outlined above, a further problem associated with current pumping systems is that the increased operating pressures ahead of the plunger cause the barrel to expand, thereby increasing the clearance between the plunger and the barrel. This causes the fuel leakage rate to increase and consequently increases parasitic power loss and fuel consumption.

Viewed from a yet further aspect, the present application relates to a pump head for a fuel injection pump, wherein a pumping chamber is formed in said pump head and an insert is provided to define at least a portion of a sidewall of the pumping chamber, the pump head being made of a first material and the insert being made of a second material, wherein the second material has a higher Young's Modulus than the first material. This arrangement is believed to be patentable independently of the other invention(s) described herein. The insert is typically a sleeve or a barrel in which a plunger reciprocates. Advantageously, by forming the insert from a material having a higher Young's Modulus, the expansion of the insert can be reduced.

The insert can have a Young's Modulus of greater than or equal to 400 MPa, or greater than or equal to 500 MPa. A suitable material for forming the insert is cemented carbide which has a Young's Modulus of approximately 550 MPa. By providing an insert having the desired properties, a modular design can be implemented in which the remainder of the pump head can be formed from a lower specification material.

Furthermore, the skilled person will understand that the arrangement of providing an insert having a higher Young's Modulus than the surrounding material is suitable for other applications, particularly in hydraulic systems. Viewed from a further aspect, the present application relates to a hydraulic system comprising a body portion, wherein a chamber is provided in said body portion for receiving a movable member, an insert being provided in the body portion to define at least a portion of a sidewall of the chamber, the body portion being made of a first material and the insert being made of a second material, wherein the second material has a higher Young's Modulus than the first material. In use, the movable member preferably cooperates with the insert to form a seal. The hydraulic system can be, for example, a control valve or an injector nozzle. The body portion can be a housing or casing for the hydraulic system.

Viewed from a yet further aspect, the present application relates to a pump head for a fuel injection pump, the pump head comprising a pumping chamber having a sidewall for cooperating with a plunger disposed therein, wherein at least the region of said pump head defining the sidewall of the pumping chamber is formed of a material having a Young's Modulus greater than or equal to 400 MPa. The use of a material having a Young's Modulus greater than 400 MPa can reduce expansion of the pumping chamber during operation. In certain embodiments, the material can have a higher Young's Modulus, for example greater than or equal to 500 MPa.

The entire pump head can be formed of the material having the specified Young's Modulus (i.e. greater than or equal to 400 MPa or 500 MPA). Alternatively, only a portion of the pump head can have this characteristic. An insert, for example in the form of a sleeve, can be provided having the specified Young's Modulus.

The insert can have a Young's Modulus of greater than or equal to 400 MPa, or greater than or equal to 500 MPa. A suitable material for forming the insert is cemented carbide which has a Young's Modulus of approximately 550 MPa.

It will be appreciated that the supply line for supplying fuel to a pump unit as described herein can be a supply gallery for supplying fuel to one or more pump units. Similarly, the outlet line can be an outlet manifold for connecting one or more pump units as described herein.

BRIEF DESCRIPTION OF THE DRAWINGS

Preferred embodiments of the present invention(s) will now be described, by way of example only, with reference to the accompanying drawings, in which.

DESCRIPTION OF THE PREFERRED EMBODIMENTS

Figure 1:
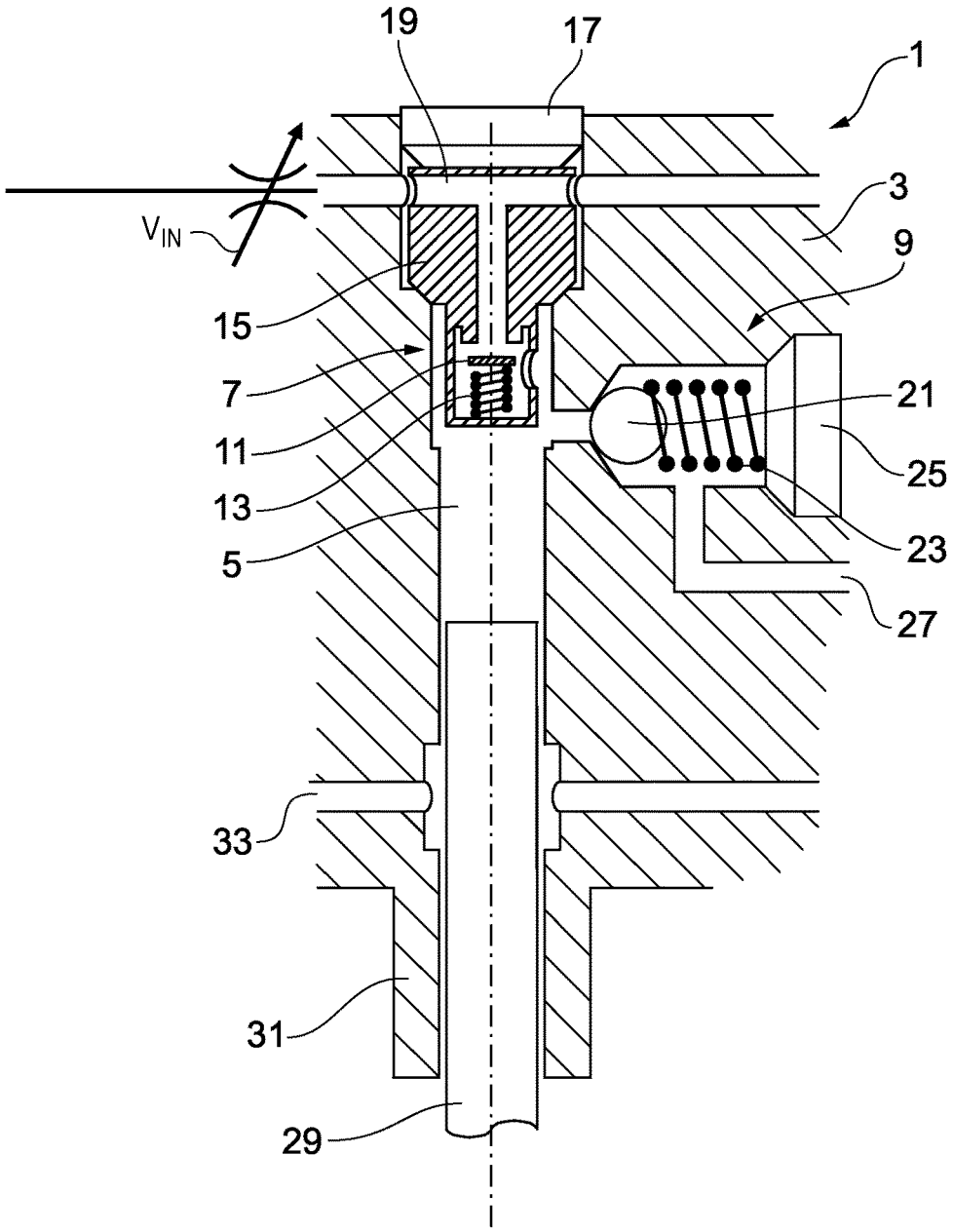
FIG. 1 (Prior Art)
FIG. 1 shows schematically a prior art pump unit.

A prior art pump unit 1 is illustrated in FIG. 1. The pump unit 1 comprises a pump head 3 comprising a pumping chamber 5, an inlet valve 7 and an outlet valve 9. The pump head 3 is typically of "monoblock" construction meaning that it is formed in a single piece, for example as a one-piece forging.

The inlet valve 7 comprises a movable inlet valve member 11, an inlet valve return spring 13, an inlet valve body 15 and an inlet valve plug 17. The inlet valve member 11 is movable between open and closed positions to control the supply of fuel to the pumping chamber 5 from a low pressure supply gallery 19. An inlet metering valve $V_{IN}$ is provided in communication with the low pressure supply gallery 19 to control the supply of fuel.

The inlet valve 7 has two static seals; a first high pressure static seal provided on the inlet valve body 15, and a second low pressure static seal provided on the inlet valve plug 17. The high pressure static seal is exposed to a pressure that alternates between very low and very high levels for many millions of cycles. Due to differential radial expansion of the valve body 15 and the pump head 3 relative motion between the surface on each side of the seal interface can occur, even if this motion is extremely small (i.e. microns) fretting wear and failure can occur.

The outlet valve 9 comprises a movable outlet valve member 21, an outlet valve return spring 23 and an outlet valve plug 25. The outlet valve 9 controls the supply of fuel from the pumping chamber 5 to a high pressure outlet gallery 27. The outlet valve 9 also has a high pressure static seal which may fail due to motion of the parts at the seal interface due to pressure fluctuation, potentially resulting in an external fuel leak. The static sealing surfaces of both the inlet valve 7 and the outlet valve 9 are difficult to machine because they are integral with the pump head 3, typically leading to higher processing costs.

A plunger 29 is provided for pressurising fuel within the pumping chamber 5. The plunger 29 is movable axially in a barrel 31 formed in the pump head 3. The plunger 29 is typically driven by a cam (not shown) mounted on a rotatable cam shaft. A low pressure drain gallery 33 is provided for collecting fuel which escapes from the pumping chamber 5 around the outside of the plunger 29.

In use, fuel is supplied to the pumping chamber 5 from the low pressure supply gallery 19 via the inlet valve 7. During a first phase, the plunger 29 is retracted within the pumping chamber 5 causing fuel to be drawn from the supply gallery 19 into the pumping chamber 5. The pressure differential between the supply gallery 19 and the pumping chamber 5 ensures that the inlet valve member 11 is displaced to or remains in an open position. In the next phase, the plunger 29 is advanced into the pumping chamber 5 resulting in an increase in fuel pressure in the pumping chamber 5 which in turn permits the inlet valve member 11 to be displaced to a closed position in response to the action of the inlet return spring 13. The continued advancement of the plunger 29 increases the pressure within the pumping chamber 5 further and, once the pressure is greater than that within the high pressure outlet gallery 27, the outlet valve member 21 is displaced to an open position allowing pressurised fuel to exit the pumping chamber 5 through the high pressure outlet gallery 27. These steps are then repeated in sequence in each pump cycle.

The outlet valve 9 is connected to the pumping chamber 5 by an intersecting drilling (arranged at 90°). However, this geometry can result in increased operational stresses. So that stresses can be reduced, expensive machining processes may be required to radius the edges of the intersecting bore (for example, abrasive flow machining may be used since the restricted access may render conventional machining unsuitable). Moreover, increased pressure specification for the pump unit may mean that it is not possible to keep stress sufficiently low with an intersecting geometry.

The inlet valve spring 13 is contained inside the high pressure pumping chamber 5. However, this arrangement has the drawback that it is difficult to reduce the dead volume and this is likely to lead to reductions in volumetric and mechanical efficiency.

It will be appreciated that the pump head 3 is a single component that contains high pressure static seals and plunger bores. As a result, a large number of processes must be undertaken on the pump head 3 with the potential for high scrap rate and scrap costs. Additionally, the material from which the pump head 3 is formed is very highly stressed in only a few small regions meaning that the vast majority of the volume of the pump head 3 (circa 90% or about 2 kilograms) is at low stress. The consequence is that a higher specification material must be used when for the majority of the pump head 3 a lower specification material would be sufficient.

Furthermore, in use, the barrel 31 can expand as the pressure in the pumping chamber 5 increases. This expansion can allow fuel to leak past the plunger 29 resulting in a reduction in efficiency of the pump unit 1. Any fuel that leaks around the plunger 29 is collected in the low pressure drain gallery 33.

Figure 2:
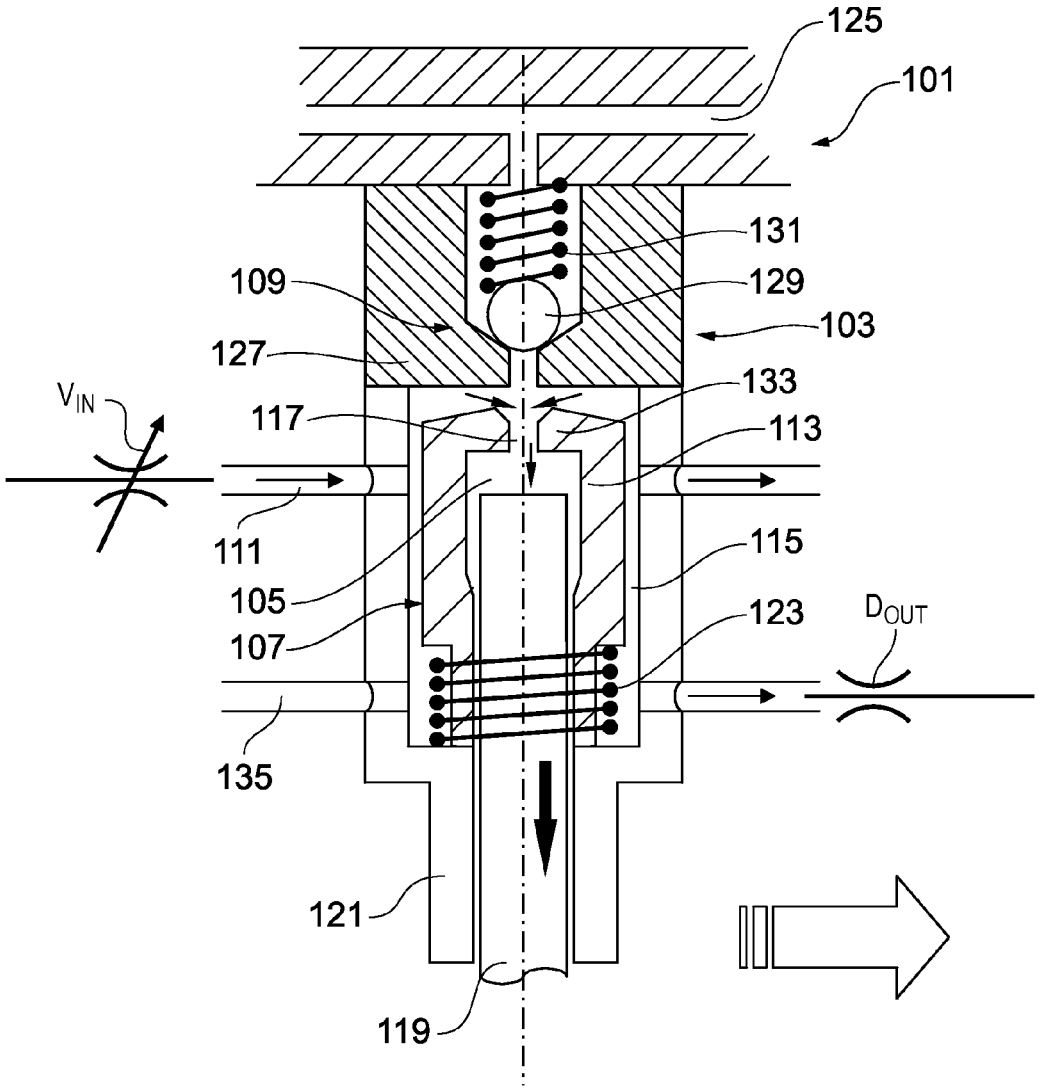
FIG. 2 shows a first embodiment of a pump unit in accordance with the present invention.

A pump unit 101 in accordance with a first embodiment of the present invention is shown schematically in FIG. 2. The pump unit 101 comprises a pump head 103, a pumping chamber 105, an inlet valve 107 and an outlet valve 109. It will be appreciated that a plurality of pumping chambers 105 can be formed in the pump head 103, but only one will be described herein for the sake of simplicity.

The inlet valve 107 is provided to control the supply of fuel from a low pressure supply gallery 111 to the pumping chamber 105. The inlet valve 107 comprises an inlet valve member 113 which is located in a low pressure chamber 115 formed within the pump head 103. The low pressure chamber 115 has a diameter greater than that of the inlet valve member 113 such that the inlet valve 107 is in the form of a concentric valve. The inlet valve member 113 can be formed of a conventional material, such as steel. Preferably, however, the inlet valve member 113 is formed from a material having a high Young's Modulus, for example cemented carbide.

An inlet metering valve $V_{IN}$ is provided in communication with the low pressure supply gallery 111 to control the supply of fuel.

The inlet valve member 113 is a one-piece sleeve partially closed at a first end, the interior of the sleeve defining the pumping chamber 105. An aperture 117 is provided at the first end of the inlet valve member 113. The interior of the inlet valve member 113 is open at a second end to receive a plunger 119 for pressurising fuel in the pumping chamber 105. A seal is formed between the plunger 119 and the inlet valve member 113 to seal the pumping chamber 105.

The plunger 119 reciprocates within a barrel 121 formed in the pump head 103. The barrel 121 in the present embodiment is a bore formed in the pump head 103. A seal is formed between the plunger 119 and the barrel 121 in known manner. The skilled person will appreciate that the gap illustrated between the plunger 119 and the barrel 121 is to improve the clarity of the Figures and is not representative of the pump unit 101.

The inlet valve member 113 is movable axially from a first position in which the inlet valve 107 is open (as shown in FIG. 2) to a second position in which the inlet valve 107 is closed. An inlet valve return spring 123 is provided to bias the inlet valve member 113 to the second position in which the inlet valve 107 is closed. When the inlet valve member 113 is in said first position, the inlet gallery 111 and the low pressure chamber 115 are in fluid communication with the pumping chamber 105 via the aperture 117 to allow fuel to enter the pumping chamber 105. When the inlet valve member 113 is in said second position, the pumping chamber 105 is in fluid communication exclusively with the outlet valve 109 via the aperture 117 to allow the fuel in the pumping chamber 105 to be pressurised.

The outlet valve 109 controls the supply of pressurised fuel from the pumping chamber 105 to a high pressure manifold 125. The outlet valve 109 comprises an outlet valve body 127, an outlet valve member 129 and an outlet valve return spring 131. The outlet valve member 129 is movable axially to open and close the outlet valve 109.

An annular projection 133 is formed on an upper face of the inlet valve member 113 around the aperture 117. The projection 133 could define a sharp edge for contacting the outlet valve body 127. Preferably, however, the projection 133 defines a flat surface for contacting the outlet valve body 127 to form a seal. The projection 133 abuts the outlet valve body 127 when the inlet valve member 113 is in said second position to form a seal around the inlet to the outlet valve 109, thereby sealing the pumping chamber 105. It will be appreciated that more than one annular projection 133 can be provided. For example, two annular projections 133 can be provided to form inner and outer seals.

A low pressure drain gallery 135 is provided for collecting fuel which escapes from the pumping chamber 105 around the outside of the plunger 119. This leakage can occur as a result of expansion of the barrel 121 caused by pressurisation of the fuel within the pumping chamber 105. A drain flow restrictor $D_{OUT}$ is provided in fluid communication with the drain gallery 135 to increase the pressure of the leaked fuel upstream in the drain gallery 135.

The operation of the pump unit 101 will now be described with reference to FIGS. 3A to 3D.

Figures 3A, 3B, 3C, 3D:
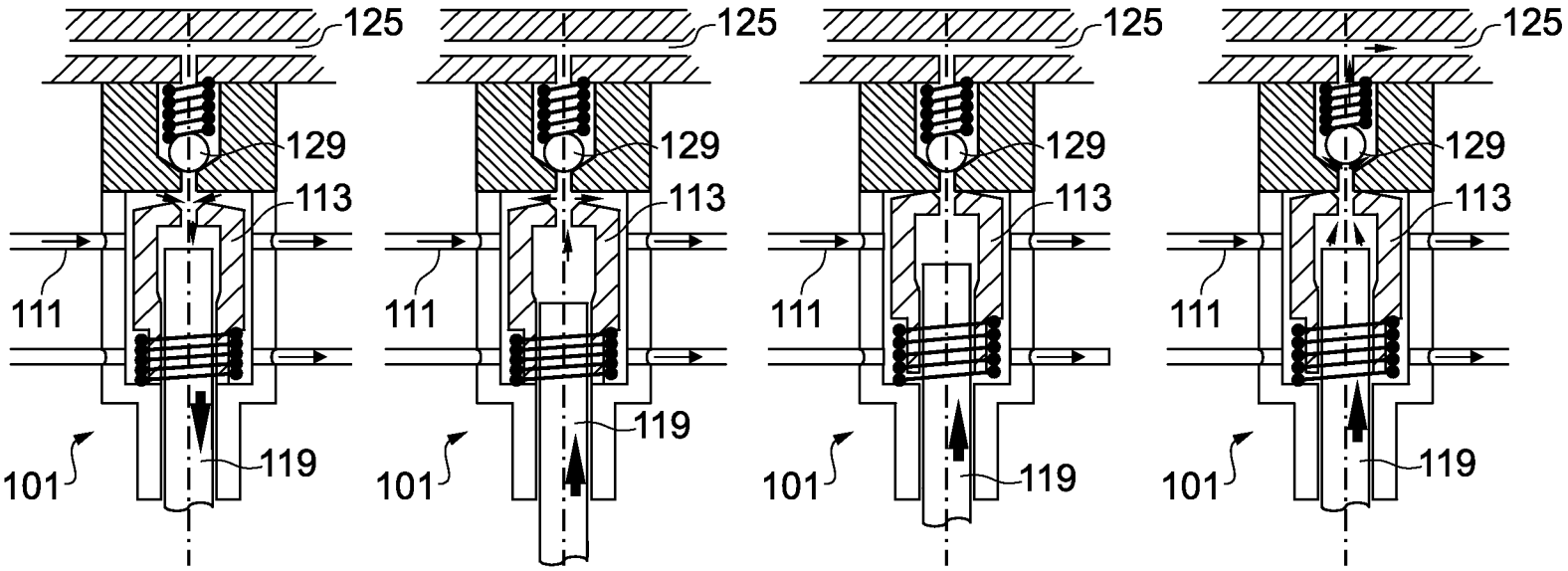
FIGS. 3A to 3D illustrate the different steps in the operational cycle of the pump unit according to the first embodiment.

The fuel is supplied to the pump unit 101 through the low pressure supply gallery 111. As illustrated in FIG. 3A, during a first phase, the plunger 119 is retracted within the pumping chamber 5, reducing the pressure within the pumping chamber 105 and causing the inlet valve member 113 to move to its first position in which the inlet valve 107 is open. Fuel is drawn into the pumping chamber 105 from the low pressure supply gallery 111 during this phase.

As illustrated in FIG. 3B, during a second phase the plunger 119 is advanced, thereby reversing the direction of flow of fuel through the aperture 117 and causing a switch in the pressure differential between the pumping chamber 105 and the low pressure supply gallery 111. The change in pressure combined with the bias of the inlet return spring 123 causes the inlet valve member 113 to be displaced to its second position such that the projection 133 abuts the outlet valve body 127. The projection 133 forms a seal around the aperture 117 thereby closing the fluid pathway between the low pressure chamber 115 and the pumping chamber 105. The pumping chamber 105 is thereby sealed and the fuel in the pumping chamber 105 is pressurised by the continued advancement of the plunger 117, as shown in FIG. 3C.

When the pressure in the pumping chamber 105 exceeds the pressure in the high pressure manifold 125, the outlet valve member 129 is unseated from the outlet valve body 127, against the action of the outlet valve return spring 131, and the outlet valve 109 is opened thereby allowing pressurised fuel to be discharged from the pumping chamber 105 to the high pressure manifold 125.

It will be appreciated that the arrangement of the inlet valve member 113 according to this embodiment allows the pumping chamber 105 and the inlet valve 107 to be combined into one component. Advantageously, this eliminates the high pressure static seal from the inlet valve assembly. Moreover, the inlet valve return spring 123 can be moved from the pumping chamber 105 to the low pressure system and, at least in preferred embodiments, dead volume can be reduced and efficiency improved.

The inlet valve member 113, the outlet valve member 129 and the plunger 119 are all movable co-axially in this embodiment. Moreover, the inlet to the outlet valve 109 and the aperture 117 in the inlet valve member 113 extend co-axially. Thus, the operational stresses of the pump unit 101 can be reduced and the manufacturing process simplified.

Figure 4:
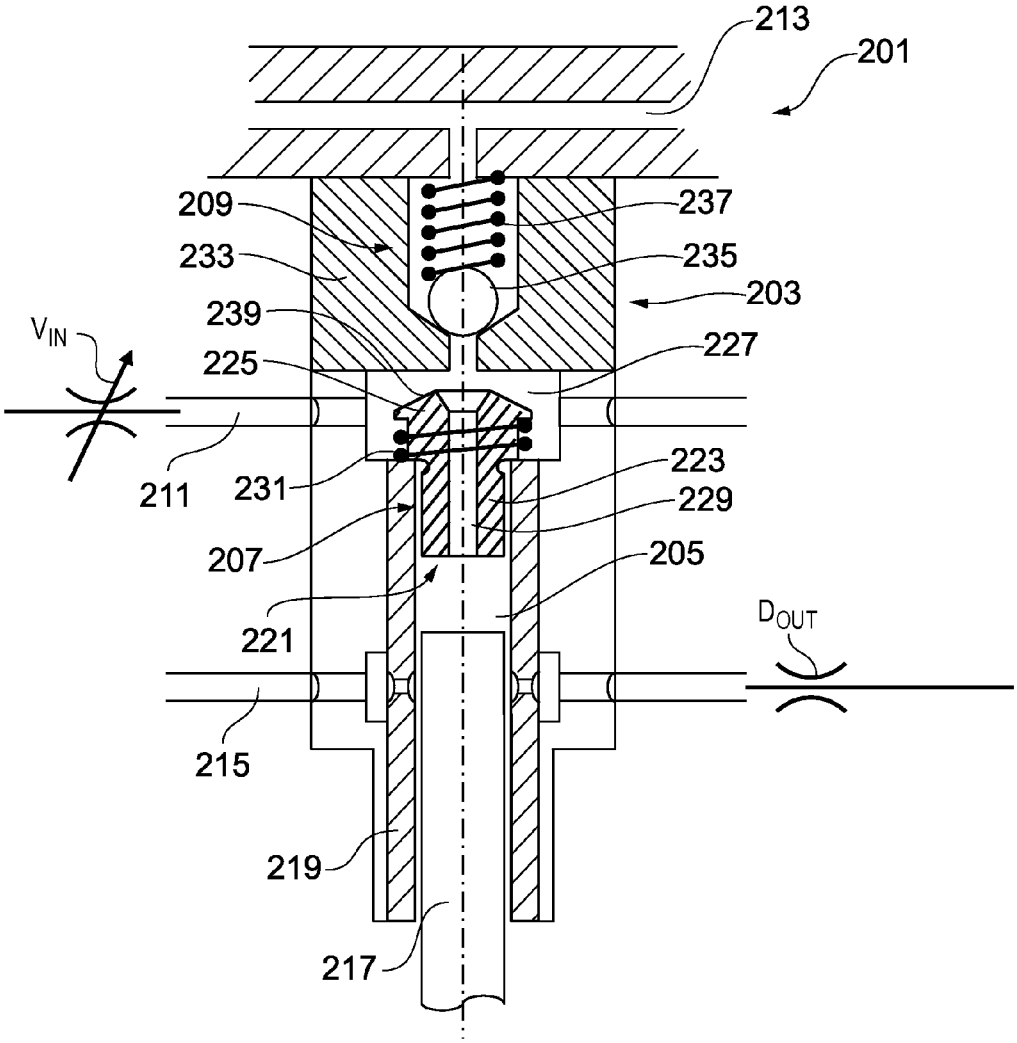
FIG. 4 shows a second embodiment of a pump unit in accordance with the present invention.

A pump unit 201 according to a second embodiment of the present invention is shown in FIG. 4. The pump unit 201 comprises a pump head 203, a pumping chamber 205, an inlet valve 207 and an outlet valve 209. The fuel is supplied to the pumping chamber 205 from a low pressure inlet gallery 211 and is expelled from the pumping chamber 205 to a high pressure manifold 213.

An inlet metering valve $V_{IN}$ is provided in communication with the low pressure supply gallery 211 to control the supply of fuel. A low pressure drain gallery 215 is provided to collect fuel that leaks from the pumping chamber 205. A drain flow restrictor $D_{OUT}$ can optionally be provided in fluid communication with the drain gallery 215 to pressurise the fuel upstream in the drain gallery 215.

A plunger 217 is provided for pressurising fuel within the pumping chamber 205. The plunger 217 is movable axially within a barrel 219 located in the pump head 203 and a seal is formed between the plunger 217 and the barrel 219 in known manner. The barrel 219 in the present embodiment is a sleeve inserted into the pump head 203. The barrel 219 is made of a material having a higher Young's Modulus than the remainder of the material forming the pump head 203. This is advantageous since it can reduce leakage around the plunger 217. A suitable material for forming the barrel 219 is cemented carbide which has a Young's Modulus of 550 MPa, approximately two and a half times that of steel. It will be appreciated that the sleeve forming the barrel 219 could be omitted such that the barrel 219 is formed directly in the pump head 203.

The inlet valve 207 comprises an inlet valve member 221 for controlling the flow of fuel into the pumping chamber 205. The inlet valve member 221 is movable axially from a first position in which the inlet valve 207 is open (as shown in FIG. 4) to a second position in which the inlet valve 207 is closed. The inlet valve member 221 comprises a cylindrical body portion 223 which locates sealingly in the barrel 219; and a head portion 225 positioned in a low pressure chamber 227 into which fuel is supplied from the inlet gallery 211. An aperture 229 extends axially through both the body portion 223 and the head portion 225 of the inlet valve member 221. The low pressure chamber 227 has a larger diameter than the head portion 225 of the inlet valve member 221 such that the inlet valve 207 takes the form of a concentric valve.

When the inlet valve member 221 is in said first position, the inlet gallery 211 and the low pressure chamber 227 are in fluid communication with the pumping chamber 205 via the aperture 229 to allow fuel to enter the pumping chamber 105. When the inlet valve member 221 is in said second position, the pumping chamber 205 is in fluid communication exclusively with the outlet valve 209 via the aperture 229 to allow the fuel in the pumping chamber 105 to be pressurised. A return spring 231 is provided to bias the inlet valve member 221 to said second position.

The outlet valve 209 is generally unchanged from that of the first embodiment of the present invention and comprises an outlet valve body 233, an outlet valve member 235 and an outlet return spring 237. As in the first embodiment, the outlet valve 209 controls the supply of pressurised fuel from the pumping chamber 205 to the high pressure manifold 213. The outlet valve member 235 is movable axially to open and close the outlet valve 209.

An annular projection 239 is formed on an upper face of the inlet valve member 221 for abutting the outlet valve body 233 to form a seal around the inlet to the outlet valve 209. The projection 239 can thereby form a seal to separate the low pressure supply gallery 211 and the pumping chamber 205. The projection 239 could define a sharp edge for contacting the outlet valve body 233. Preferably, however, the projection 239 defines a flat surface for contacting the outlet valve body. It will be appreciated that more than one projection 239 can be provided. For example, two projections 239 can be provided to define concentric surfaces forming inner and outer seals.

The operation of the pump unit 201 in accordance with the second embodiment of the present invention will now be described with reference to FIGS. 5A to 5D.

Figures 5A, 5B, 5C, 5D:
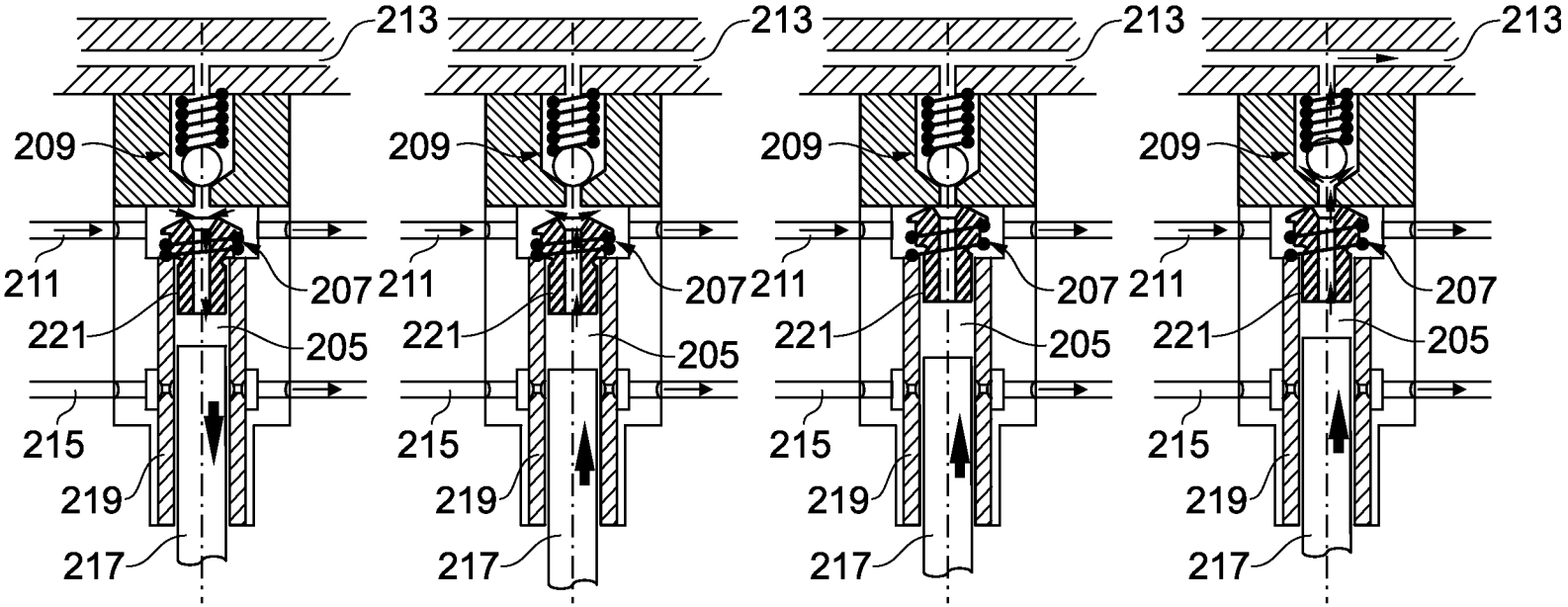
FIGS. 5A to 5D illustrate the different steps in the operational cycle of the pump unit according to the second embodiment.

As shown in FIG. 5A, during a first phase, the plunger 217 is retracted within the pumping chamber 205, reducing the pressure within the pumping chamber 205 and causing the inlet valve member 221 to move to said first position. The inlet valve 207 is thereby opened and fuel is drawn into the pumping chamber 205 from the low pressure supply gallery 211.

During a second phase, the plunger 217 is advanced into the pumping chamber 205, as shown in FIG. 5B, causing an increase in the pressure within the pumping chamber 205. The pressure differential switch between the pumping chamber 205 and the low pressure chamber 227 permits the inlet valve member 221 to be displaced to said second position, as shown in FIG. 5C, in which the annular projection 239 abuts the outlet valve body 233, closing the inlet valve 207 and preventing fluid communication between the low pressure supply gallery 211 and the pumping chamber 205. The pumping chamber 205 is thereby sealed and the continued advancement of the plunger 217 pressurises the fuel within the pumping chamber 205. Once the pressure of the fuel in the pumping chamber 205 exceeds the pressure in the high pressure manifold 213, the outlet valve 209 is opened against the action of the outlet return spring 237 and pressurised fuel exits the pumping chamber 205 to the high pressure manifold 213, as shown in FIG. 5D.

The second embodiment differs from the first embodiment in that the pumping chamber 205 and the inlet valve 207 are separate components. This offers the advantage that the inlet valve 207 can be made relatively small and its mass reduced to provide improved dynamic performance, at least in preferred embodiments. The concentric arrangement of the inlet valve 207 and the outlet valve 209 can also help to reduce stress loads as well as reducing the dead volume of the pump unit 201.

Due to expansion of the barrel 219 when the plunger 217 is advanced, fuel within the pumping chamber 205 can escape past the plunger 217. This leakage is collected in the low pressure drain gallery 215.

Figure 6:
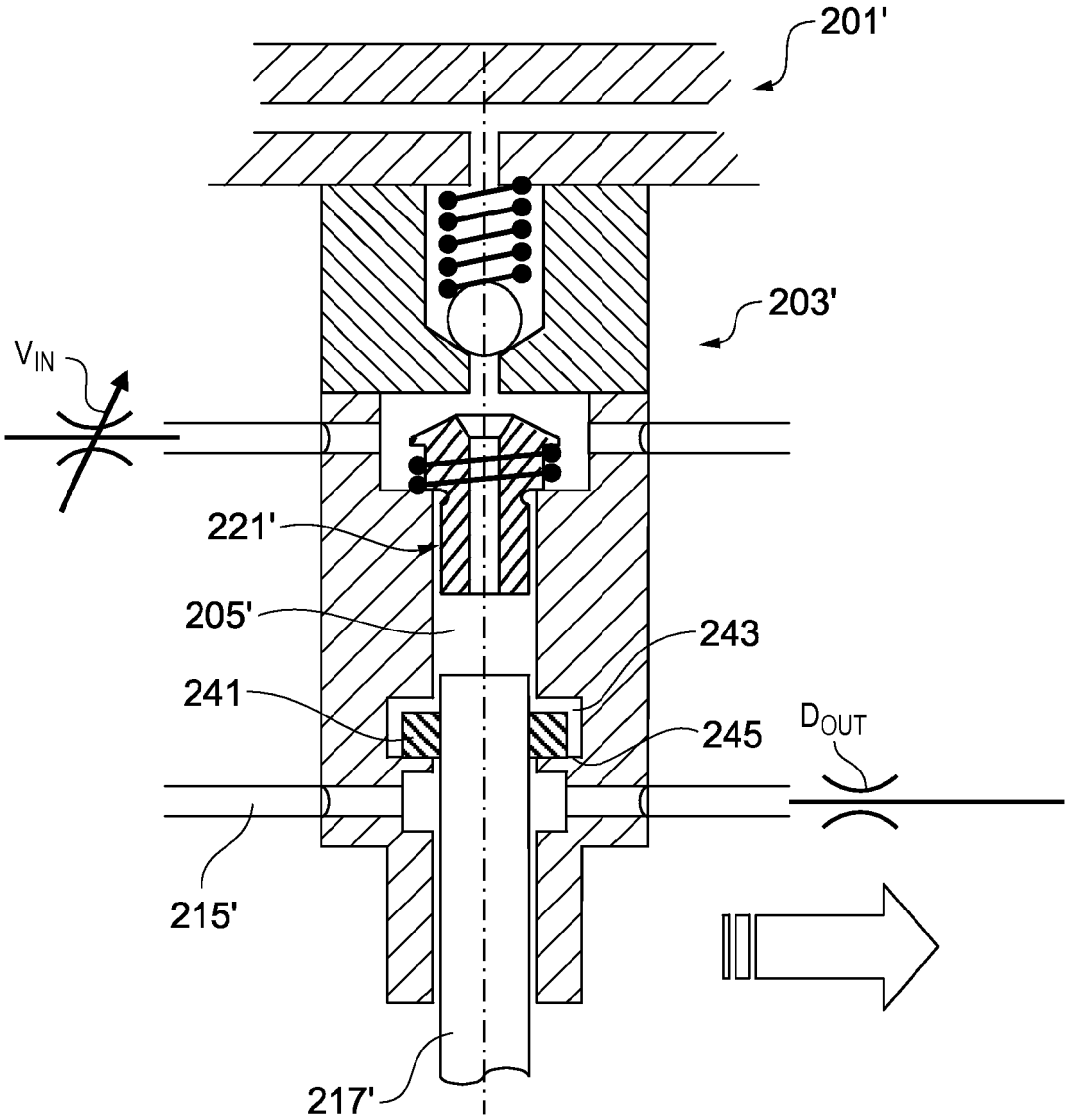
FIG. 6 shows a first modified version of the second embodiment of the present invention.

A pump unit 201' which is a modified version of the pump unit 201 according to the second embodiment is illustrated in FIG. 6. For the sake of brevity, like reference numerals have been used for like components.

The pump unit 201' is provided with a piston ring 241 to help reduce leakage from the pumping chamber 205' to the low pressure drain gallery 215'. The piston ring 241 is located in a concentric recess 243 formed in the pump head 203' and is movable axially along the plunger 217'.

As the plunger 217' advances, the increased pressure within the pumping chamber 205' displaces the piston ring 241 downwardly (i.e. in the opposite direction to the direction of travel of the plunger 217') such that it seats on a bottom face 245 of the recess 243. The pressure of the fuel acting on the exterior of the piston ring 241 prevents the piston ring 241 from expanding and can cause it to contract around the plunger 217'. It will be appreciated, therefore, that a first seal is formed between the piston ring 241 and the bottom face 245 of the recess 243 and a second seal is formed between the plunger 217' and an internal surface of the piston ring 241. Thus, the piston ring 241 forms seals on two faces to seal the pumping chamber 205'.

In use, the piston ring 241 does not expand radially because it is exposed to the pumping pressure on all sides, unlike the conventional barrel 219 which is exposed to pressure only internally. Accordingly, the piston ring 241 does not expand radially when pressure is increased, so clearance between the ring 241 and the plunger 217' can be kept small and leakage reduced. Thus, the piston ring 241 can reduce or minimise leakage around the plunger 217'. This arrangement can help to minimise parasitic energy loss and improve system efficiency (fuel consumption), at least in preferred embodiments.

It is envisaged that it may prove difficult to control the pressure gradient applied by the piston ring 241. In particular, as the pressure on the inside of the piston ring 241 is decreasing from the high pressure side to the low pressure side, there will be a pressure gradient established. This means that the pressure may not be completely equal from the inside to the outside and it is possible that the piston 241 will compress radially and grip the plunger 217'. This may be undesirable for reasons of durability and efficiency (due to increased friction). To help address this issue, the ring could be developed to include an internal profile that improves the pressure balance and reduces radial compression. Additionally, the ring could be made of a higher Young's Modulus material to reduce the radial compression.

Figure 7:
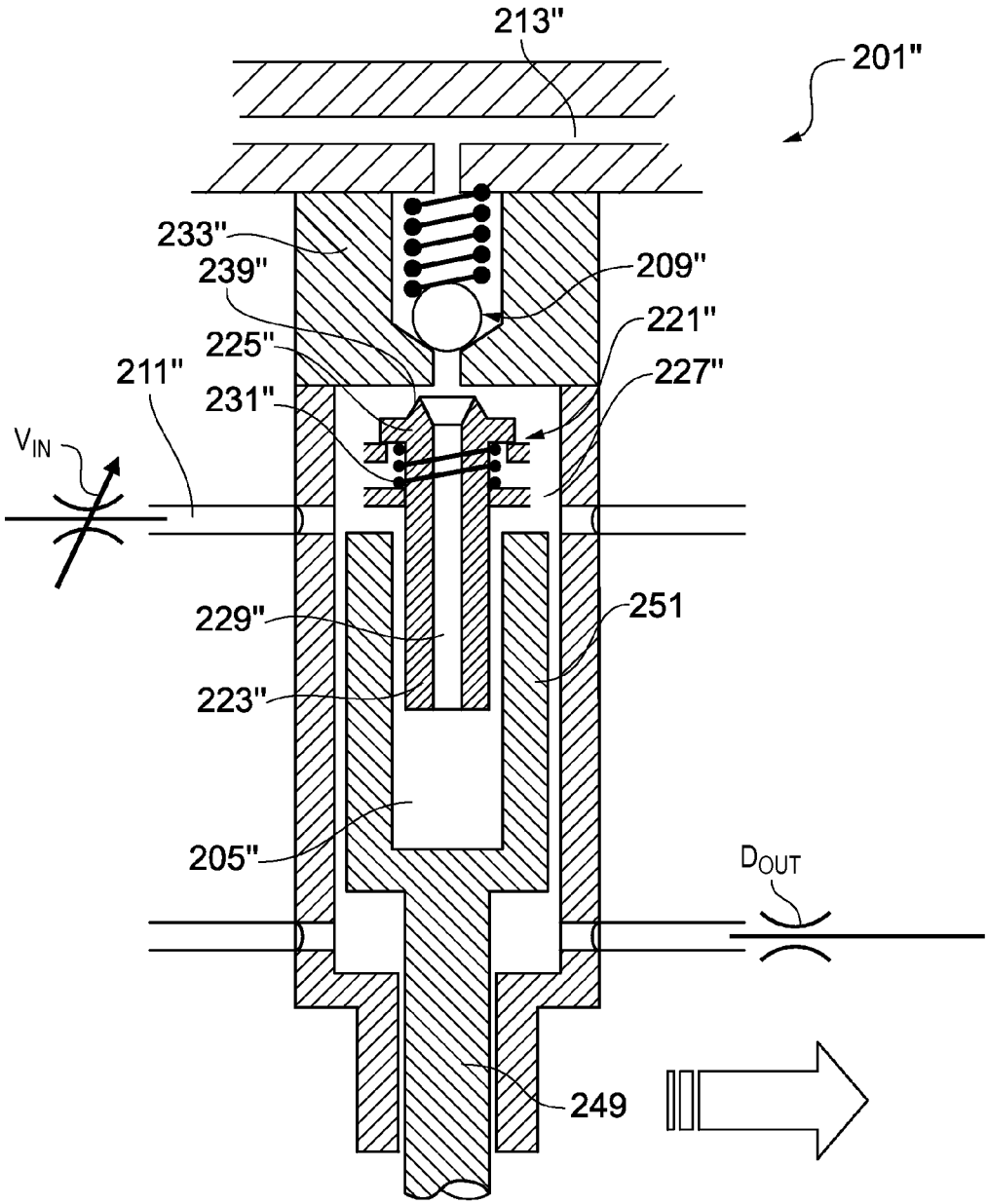
FIG. 7 shows a second modified version of the second embodiment of the present invention.

A pump unit 201" which is a further modified version of the pump unit 201 according to the second embodiment is illustrated in FIG. 7. For the sake of brevity, like reference numerals have been used for like components.

The pump unit 201" in this arrangement is modified such that the plunger 217 is replaced with a pushrod 249. A sleeve 251 is provided on the end of the pushrod 249 to form the pumping chamber 205". The body portion 223" of the inlet valve member 221" is slidably located within the sleeve 251 provided on the pushrod 249 to function as a plunger for pressurising fuel within the pumping.

As in the previous embodiments, the inlet valve member 221" is movable between first and second positions to control the supply of fuel into and out of the pumping chamber 205". When the inlet valve member 221" is in its first position, a first fluid pathway from the low pressure supply gallery 211" to the pumping chamber 205" is open. When the inlet valve member 221" is in its second position, the first fluid pathway is closed and a second fluid pathway from the pumping chamber 205" to the outlet valve 209" is open. Thus, when the inlet valve member 221" is in said second position, the pumping chamber 205" communicates exclusively with the outlet valve 209" via the aperture 229". A return spring 231" is provided to bias the inlet valve member 221" towards the second position. The operation of the pump unit 201" will now be described.

During a first phase, the pushrod 249 is retracted, reducing the pressure within the pumping chamber 205" and causing the inlet valve member 221" to move to said first position. The inlet valve 207" is thereby opened and fuel is drawn into the pumping chamber 205 from the low pressure supply gallery 211".

During a second phase, the pushrod 249 is advanced causing the body portion 223" of the inlet valve member 221" to be introduced into the sleeve 251. This results in an increase in the pressure of the fuel within the pumping chamber 205". The pressure differential switch between the pumping chamber 205" and the low pressure chamber 227" permits the inlet valve member 221" to be displaced to said second position. The annular projection 239" formed on the head portion 225" of the inlet valve member 221" thereby abuts the outlet valve body 233" and the inlet valve 207" is closed, sealing the pumping chamber 205" and preventing fluid communication with the low pressure supply gallery 211". The continued advancement of the pushrod 249 pressurises the fuel within the sealed pumping chamber 205". Once the pressure of the fuel in the pumping chamber 205" exceeds the pressure in the high pressure manifold 213", the outlet valve 209" is opened and pressurised fuel exits the pumping chamber 205", through the aperture 229" and the outlet valve 209", to the high pressure manifold 213".

This modified arrangement allows the size of the inlet valve 209" to be reduced. However, it will be appreciated that the inlet valve member 221" needs to be sufficiently long to stay engaged in the sleeve 251 as the pushrod 249 is retracted.

Figure 8:
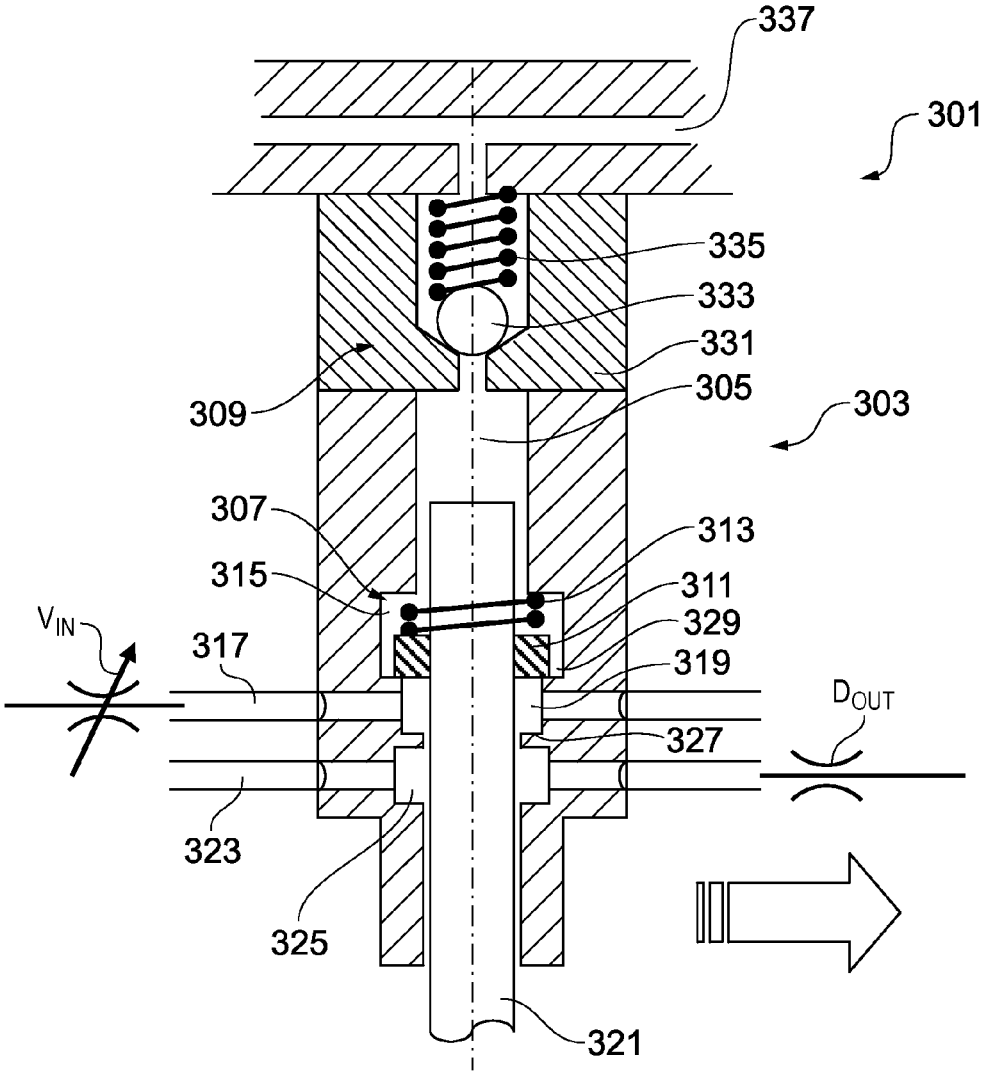
FIG. 8 shows a pump unit in accordance with a third embodiment of the present invention.

A pump unit 301 in accordance with a third embodiment of the present invention will now be described with reference to FIG. 8.

The pump unit 301 comprises a pump head 303, a pumping chamber 305, an inlet valve 307 and an outlet valve 309. In this embodiment, the inlet valve 307 comprises a piston ring 311 and a piston ring return spring 313, both located in an annular recess 315 formed in the pump head 303.

A supply of fuel is provided from a low pressure supply gallery 317 into a first annular chamber 319 provided around a plunger 321. The first annular chamber 319 is open to a first side of the piston ring 311. A low pressure drain gallery 323 is connected to a second annular chamber 325 also extending around the plunger 321.

The first and second annular chambers 319, 325 are separated from each other by an annular flange 327 which sealingly engages the plunger 321 about its circumference. The pumping chamber 305 has a diameter larger than that of the plunger 321 to allow fuel to enter the pumping chamber 305 around the plunger 321.

An inlet metering valve $V_{IN}$ is provided in communication with the low pressure supply gallery 317 to control the supply of fuel. A drain flow restrictor $D_{OUT}$ is provided in fluid communication with the drain gallery 323 to increase the fuel pressure upstream in the drain gallery 323.

The piston ring 311 is movable between a lifted position and a seated position abutting a bottom face 329 of the annular recess 315 (as shown in FIG. 7). With the piston ring 311 in said lifted position, the low pressure supply gallery 317 is in fluid communication with the pumping chamber 305 and, therefore, the inlet valve 307 is open. With the piston ring 311 in said seated position, the pumping chamber 305 is sealed and, therefore, the inlet valve 307 is closed.

The outlet valve 309 is generally unchanged from the previous embodiments described herein and comprises an outlet valve body 331, an outlet valve member 333 and an outlet return spring 335. The outlet valve 309 controls the flow of fuel from the pumping chamber 305 to a high pressure manifold 337.

The operation of the pump unit 301 in accordance with the third embodiment will now be described.

During a first phase, the plunger 321 is retracted within the pumping chamber 305 thereby reducing the pressure within the pumping chamber 305. When the pressure within the pumping chamber 305 is less than that in the low pressure supply gallery 317, the piston ring 311 lifts from the bottom face 329 of the annular recess 315 and opens the inlet valve 307 to allow fuel to enter the pumping chamber 305.

During a second phase, the plunger 321 is advanced into the pumping chamber 305 causing an increase in the pressure within the pumping chamber 305 which in turn causes the piston ring 311 to return to its seated position abutting the bottom face 329 of the annular recess 315 and closing the inlet valve 307. The pumping chamber 305 is thereby sealed and the continued motion of the plunger 321 increases the pressure within the pumping chamber 305 until it is higher than that in the high pressure manifold 337. The outlet valve member 333 is then unseated against the action of the outlet return spring 335 and the outlet valve 309 opens to allow pressurised fuel to be discharged from the pumping chamber 305 into the high pressure manifold 337.

The pump unit 301 according to the third embodiment of the present invention advantageously uses the piston ring 311 to provide a seal around the plunger 321 to reduce leakage and also to act as an inlet valve 307. Thus, the number of components in the pump unit 301 can be reduced.

The arrangement according to the second embodiment whereby an insert is provided in the pump head 203 to define the barrel 219 in which the piston 217 reciprocates is considered to be patentable independently of the other invention(s) described herein. Indeed, it is believed that the prior art pump unit 1 could be modified to incorporate a sleeve made of cemented carbide to define the barrel 31. Of course, other materials could be employed for the sleeve provided they have a Young's Modulus higher than that of the material from which the pump head 3 is formed.

Figure 9:
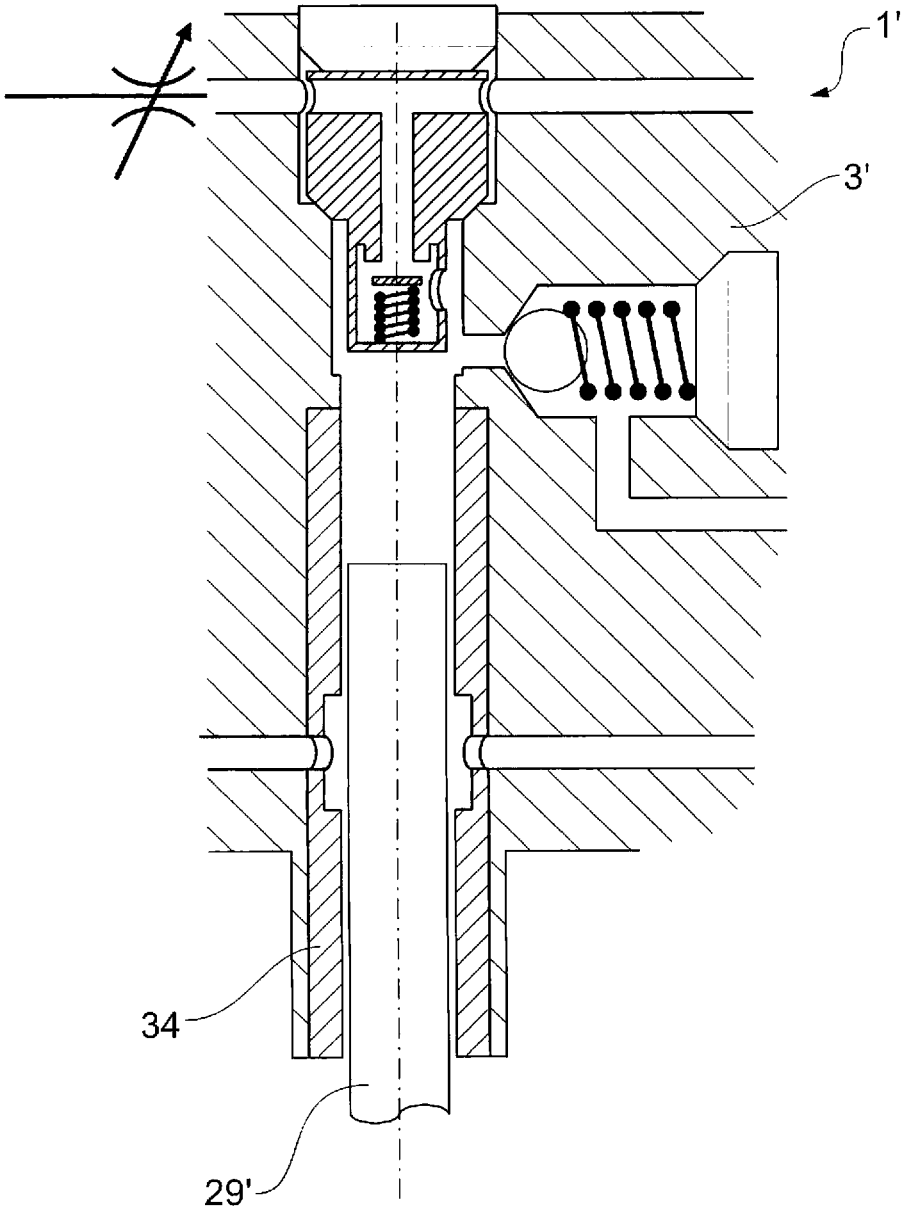
FIG. 9 shows a pump unit having a sleeve inserted in the pump head to define the barrel in which the plunger travels.

A modified pump unit 1' is illustrated in FIG. 9 and like reference numerals have been used for like components. A cemented carbide sleeve 34 is fixedly mounted in the pump head 3' to receive the plunger 29'. The sleeve 34 is less subjectable to expansion due to the increased pressures within the pump chamber 5 and, therefore, the leakage of fuel around the plunger 29' is reduced. The operation of the pump unit 1' remains unchanged from that described previously herein.

It will be appreciated that a plurality of pumping units 1'; 101; 201, 201'; 201"; 301 described herein could be arranged in an array of two or more in order to increase the capacity of the pump. Moreover it will be understood that the plunger in the various embodiments described herein can be driven by a cam shaft or other suitable mechanical or electromechanical drive means.

The skilled person will appreciate that various changes and modifications may be made to the embodiments described herein without departing from the scope of the present invention.

The invention claimed is:

1. A pump unit for a fuel injection system, the pump unit comprising:

an inlet valve member, an outlet valve, a supply line for supplying fuel, a pumping chamber, and a plunger axially moveable within a barrel for pressurising fuel in the pumping chamber such that the plunger forms a seal with the barrel such that the pumping chamber is defined by the barrel;

the inlet valve member being movable between a first position and a second position within the barrel such that the inlet valve member radially forms a seal with the barrel to seal the pumping chamber, wherein a top surface of the plunger is below the inlet valve member;

wherein the inlet valve member has an aperture formed therein, the aperture providing a first fluid pathway between the pumping chamber and the supply line when the inlet valve member is in said first position, and the aperture providing a second fluid pathway between the pumping chamber and the outlet valve when the inlet valve member is in said second position;

wherein the outlet valve comprises a movable outlet valve member and an outlet valve body; and the inlet valve member forms a seal with the outlet valve body when the inlet valve member is in said second position wherein said inlet valve member comprises:

a body portion located sealingly in the barrel; and a head portion located in a low pressure chamber which receives fuel from the supply line.

2. A pump unit as claimed in claim 1 further comprising a return spring located outside of the pumping chamber for biasing the inlet valve member to the second position.

3. A pump unit as claimed in claim 2 wherein the return spring radially surrounds the head portion of the inlet valve member.

4. A pump unit as claimed in claim 1 wherein the aperture extends axially through the inlet valve member.

5. A pump unit as in claim 1 further comprising a sealing ring movably mounted on the plunger.

6. A pump unit as in claim 5, wherein the sealing ring is movable axially within a recess provided around the plunger.

* * * * *